US006042890A

United States Patent [19]

Rüf et al.

[11] Patent Number: 6,042,890

[45] Date of Patent: Mar. 28, 2000

[54] PROCESS FOR PRODUCING A STRENGTHENED FIBER ASSEMBLY

[75] Inventors: Harmut Rüf; Heinrich Firgo; Siegfried Ambrosch; Christian Schlossnikl, all of Vöcklabruck; Raimund Jurkovic, Lenzing, all of Austria

[73] Assignee: Lenzing Aktiengesellschaft, Lenzing, Austria

[21] Appl. No.: 09/173,822

[22] Filed: Oct. 16, 1998

Related U.S. Application Data

[63] Continuation of application No. PCT/AT98/00040, Feb. 25, 1998.

[30] Foreign Application Priority Data

Feb. 25, 1997 [AT] Austria ..... 319/97

[51] Int. Cl.[7] ..... B05D 1/38; B05D 3/10

[52] U.S. Cl. ..... 427/354; 427/369; 427/384; 427/394; 427/396; 427/439

[58] Field of Search ..... 427/384, 394, 427/395, 396, 353, 354, 369, 439

[56] References Cited

U.S. PATENT DOCUMENTS

| | | | |
|---|---|---|---|
| 2,179,181 | 11/1939 | Graenacher et al. . | |
| 3,447,939 | 6/1969 | Johnson | 106/135 |
| 3,447,956 | 6/1969 | Johnson . | |
| 3,508,941 | 4/1970 | Johnson | 106/125 |
| 4,196,282 | 4/1980 | Franks et al. | 106/168 |
| 5,094,690 | 3/1992 | Zikeli et al. | 106/198 |
| 5,589,125 | 12/1996 | Zikeli et al. | 264/187 |

FOREIGN PATENT DOCUMENTS

| | | |
|---|---|---|
| 698123 | 1/1951 | United Kingdom . |
| 9507386 | 3/1995 | WIPO . |
| 9631645 | 10/1996 | WIPO . |
| 9637653 | 11/1996 | WIPO . |

OTHER PUBLICATIONS

Goikhman et al, Vysokomol. Soedin., Ser. A (1985), 27(1), pp. 122–126.

Chanzy et al., J. App. Pol. Sci., Appl. Pol. Symp. 37, pp. 239–259 (1983).

*Primary Examiner*—Erma Cameron
*Attorney, Agent, or Firm*—Baker Botts, LLP

[57] ABSTRACT

The invention relates to a process for producing a strengthened fiber assembly containing cellulosic fibers with the cellulose being present in the crystalline structure of cellulose II, by contacting the fiber assembly with an aqueous solution of N-methylmorpholine-N-oxide (NMMO) at elevated temperature and subsequently washing the fiber assembly, characterized in that contacting is effected in a manner that from the relation $$-947+0.30\times\log_{(10)}t+0.046\times T-3.53\times C+645\times\log_{(10)}C$$

wherein t indicates the time in minutes during which the fiber assembly is contacted with the aqueous NMMO solution, T indicates the temperature of the aqueous NMMO solution in °C. and C is the concentration of NMMO in % by mass, based on the aqueous NMMO solution, a number in the range of 0.30 to 1.70 results with the proviso that the temperature T is smaller than 130° C. and the concentration C ranges between 70 and 84 % by mass.

7 Claims, No Drawings

PROCESS FOR PRODUCING A STRENGTHENED FIBER ASSEMBLY

This is a continuation of application Ser. No. PCT/AT98/00040 filed Feb. 25, 1998 which is incorporated by reference herein.

BACKGROUND OF THE INVENTION

The present invention relates to a process for producing a strengthened fiber assembly containing cellulosic fibers with the cellulose being present in the crystalline structure of cellulose II, by contacting the fiber assembly with an aqueous solution of N-methylmorpholine-N-oxide (NMMO) at elevated temperature and subsequently washing the fiber assembly.

For the purposes of this description and the annexed claims, the expression "fiber assembly" is to denote any kind of wovens, nonwovens or random webs.

During the past years, a number of processes in which cellulose is dissolved in an organic solvent, a combination of an organic solvent with an inorganic salt, or in aqueous salt solutions, without forming a derivative have been described as alternatives to the viscose process. Cellulose fibers made of such solutions were given the generic name lyocell by BISFA (The International Bureau for the Standardisation of Man-Made Fibres). According to the BISFA definition, lyocell is a cellulose fiber obtained from an organic solvent by means of a spinning process. By "organic solvent", a mixture of an organic chemical and water is understood by BISFA.

To date but a single process for the production of a cellulose fiber of the lyocell type has, however, become accepted to the point of large-scale realization, namely the amine oxide process. In that process, N-methylmorpholine-N-oxide (NMMO) is preferably used as the solvent. For the purposes of the instant specification, the term "tertiary amine oxides" substitutionally is referred to by the abbreviation "NMMO", NMMO additionally representing the presently preferred N-methylmorpholine-N-oxide.

Tertiary amine oxides have been known for long as alternative solvents for cellulose. Thus, it is known, for instance, from U.S. Pat. No. 2,179,181 that tertiary amine oxides are capable of dissolving high-quality chemical pulp without the formation of derivatives and that cellulose moulded bodies such as fibers may be obtained from such solutions by precipitation. U.S. Pat. Nos. 3,447,939, 3,447,956 and 3,508,941 describe further processes for the production of cellulose solutions with cyclic amine oxides being used as the preferred solvents. In all of those processes, cellulose is physically dissolved at elevated temperature.

In EP-A - 0 356 419 to applicant a process is decribed, which preferably is carried out in a thin-layer treating apparatus in which a suspension of the comminuted pulp in an aqueous tertiary amine oxide is spread in the form of a thin layer, transported over a heating surface, while the surface of the thin layer is exposed to a vacuum. During transportation of the suspension over the heating surface water is evaporated and the cellulose can be dissolved such that a spinnable cellulose solution is discharged from the thin-layer treating apparatus.

A process and an arrangement for spinning cellulose solutions are known, for instance, from WO 93/19230 to applicant. There, the spinning solution is spun in the hot state and the filaments obtained are introduced into a precipitation bath in order to precipitate the cellulose contained therein, the filaments being cooled prior to their introduction into the precipitation bath. Cooling is effected immediately after moulding and, preferably, consists in horizontally blowing air at the cellulose moulded body.

German Patent No. 902 427 describes the strengthening of a fleece of cellulose fibers by means of a lye bath containing 5 to 15% NaOH. The celluose fibers are swollen by the lye bath and thereby strengthened.

From WO 95/07386 to applicant, a process for producing paper is known, in which an aqueous suspension of comminuted cellulose material is mechanically treated and subsequently subjected to a sheet forming procedure, the suspension containing tertiary amine oxide. That process allows for the production of high-strength paper.

A process for strengthening a fibrous material is known from U.S. Pat. No. 3,447,956. Strengthening is effected in that the fibrous material is soaked with an amine oxide and heated to a temperature at which the amine oxide is able to strengthen the fibrous material. Proposed fibrous materials are wovens and nonwovens containing natural cellulosic fibers such as, e.g., wood pulp, cotton, linen, but also synthetic fibers such as rayon (viscose fibers). Particularly preferred is the treatment of paper with amine oxide. In doing so, NMMO apparently is used as a monohydrate in the molten or liquid state or dissolved in a volatile solvent capable of being evaporated.

From WO 96/37653 fiber assemblies provided with a cellulosic coat, impregnation or sheath are known. Those fiber assemblies are produced by coating the fiber assembly on one side with a solution of cellulose in aqueous NMMO, whereupon the layer is coagulated in a water bath.

U.S. Pat. No. 4,196,282 describes the three-component system NMMO/$H_2O$/cellulose and the so-called "dissolution frame", i.e., those conditions under which the cellulose dissolves in aqueous NMMO.

Furthermore, it is known that cellulose fibers may be swollen with NMMO (Chancy et al., "Swelling and Dissolution of Cellulose in Amine Oxide/Water Systems"; J. App. Pol. Sci: Appl. Pol. Symp. 37,239–259 (1983)).

SUMMARY OF THE INVENTION

The invention has as its object to provide a process of the initially defined kind, in which a fiber assembly can be strengthened without cumbersome evaporation of a volatile solvent and without requiring the use, or preparation by evaporation, of an NMMO monohydrate.

The process according to the invention for producing a strengthened fiber assembly containing cellulosic fibers with the cellulose being present in the crystalline structure of cellulose II, by contacting the fiber assembly with an aqueous solution of N-methylmorpholine-N-oxide (NMMO) at elevated temperature and subsequently washing the fiber assembly is characterized in that contacting is effected in a manner that from the relation $$-947+0.30\times\log_{(10)}t+0.046\times T-3.53\times C+645\times\log_{(10)}C$$

wherein t indicates the time in minutes during which the fiber assembly is contacted with the aqueous NMMO solution, T indicates the temperature of the aqueous NMMO solution in °C. and C is the concentration of NMMO in % by mass, based on the aqueous NMMO solution, a number in the range of 0.30 to 1.70 and, preferably, in the range of 0.5 to 1.5 and, in a particularly preferred manner, in the range of 0.8 to 1.2 results with the proviso that the temperature T is smaller than 130° C. and the concentration C ranges between 70 and 84% by mass.

DETAILED DESCRIPTION OF THE PREFERRED EMBODIMENT

The invention is based on the finding that, for strengthening an assembly of cellulose fibers such as, e.g., a nonwoven, the three parameters mentioned, i.e., the concentration of the NMMO solution, its temperature and the time of impregnation, apparently are essential and sufficient and that, in addition, they must be chosen such that the above relation is met. If, in contrast, these parameters are chosen such that a value smaller than 0.30 results from the relation, no strengthening of the assembly will be obtained. If, on the other hand, the parameters are chosen such that a value of more than 1.70 results from the relation, the dissolution of the fiber assembly in the NMMO solution is observed.

In the process according to the invention, the temperature T preferably is smaller than 100° C.

A particular embodiment of the process according to the invention is characterized in that the fiber assembly is pressed before washing. Pressing may be effected in a simple manner, e.g., by conducting the nonwoven between two rolls exerting a pressure on the fiber assembly.

The use of a fiber assembly containing fibers produced at least partially according to the amine oxide process or the viscose process has proved particularly successful in the process according to the invention.

The invention will be explained in more detail by way of the following examples.

GENERAL WORKING INSTRUCTION slightly needle punched viscose nonwovens each having a size of 12×16 cm and a weight per unit area of about 70 g/cm$^2$ were immersed into an aqueous NMMO solution between two sieves and allowed to impregnate, whereupon the impregnated nonwovens were pressed by means of a laboratory press (pressing pressure: 3 bars; corresponding to a line pressure of 12.6 N/mm at a nonwoven width of 12 cm). After this, the pressed nonwovens were washed with tap water for 15 minutes.

EXAMPLES

According to the above working instruction, several tests were carried out, the parameters to be set according to the invention, i.e., the concentration of the respective NMMO solution (in % by mass, based on the total mass of the solution), its temperature (in °C. ) and the time of impregnation (in minutes) having been chosen as indicated in Table 1 below. All of the examples comply with the above-defined relation. The values resulting with the respective parmeters are also apparent from the Table.

TABLE 1

| Ex. | NMMO Concentration | Temperature | Time | Value |
|---|---|---|---|---|
| 1 | 84.0 | 80 | 0.08 | 0.95 |
| 2 | 82.0 | 80 | 0.08 | 1.30 |
| 3 | 82.0 | 70 | 0.17 | 0.94 |
| 4 | 80.6 | 70 | 0.50 | 1.20 |
| 5 | 80.6 | 80 | 0.08 | 1.42 |
| 6 | 80.6 | 80 | 0.50 | 1.66 |
| 7 | 78.2 | 70 | 1.00 | 1.29 |
| 8 | 76.2 | 70 | 0.50 | 1.00 |
| 9 | 76.2 | 80 | 0.17 | 1.32 |
| 10 | 73.9 | 70 | 4.00 | 0.81 |
| 11 | 74.2 | 80 | 0.50 | 1.07 |
| 12 | 74.2 | 90 | 0.17 | 1.39 |
| 13 | 71.9 | 90 | 2.00 | 1.02 |
| 14 | 71.9 | 100 | 0.17 | 1.16 |
| 15 | 70.0 | 100 | 0.50 | 0.49 |

Examples 1 to 15 fall within the scope of invention, since the values resulting from the abovementioned relation with the NMMO concentrations, temperatures and times of impregnation are within the range defined by the invention. All of the nonwovens were found to be strengthened after having been treated according to the invention.

Similarly good results could be obtained with a nonwoven comprised of fibers produced according to the amine oxide process.

COMPARATIVE EXAMPLES

For reasons of comparison, additional tests were carried out according to the general working instruction, yet the parameters had been chosen such that the relation was not met. These examples are summarized in Table 2.

TABLE 2

| Ex. | NMMO Concentration | Temperature | Time | Value |
|---|---|---|---|---|
| 16 | 82.0 | 90 | 0.17 | 1.86 |
| 17 | 80.6 | 80 | 1.00 | 1.75 |
| 18 | 80.6 | 90 | 0.08 | 1.88 |
| 19 | 78.2 | 80 | 2.00 | 1.84 |
| 20 | 78.2 | 90 | 0.08 | 1.88 |
| 21 | 76.2 | 90 | 0.50 | 1.92 |
| 22 | 76.2 | 100 | 0.08 | 2.14 |
| 23 | 74.2 | 100 | 0.08 | 1.75 |
| 24 | 72.2 | 70 | 4.00 | 0.29 |
| 25 | 72.2 | 120 | 4.00 | 2.59 |
| 26 | 70.0 | 80 | 12.0 | −0.10 |
| 27 | 70.0 | 90 | 2.00 | 0.21 |
| 28 | 70.0 | 100 | 0.08 | 0.25 |

We claim:

1. Process for producing a strengthened fiber assembly including fibers of cellulose, said cellulose having a structure wherein said structure is the crystalline structure of cellulose II, which process comprises the steps of:

providing an aqueous solution of N-methylmorpholine-N-oxide, contacting said fiber assembly with said aqueous solution of N-methylmorpholine-N-oxide at elevated temperature in accordance with the following relation so as to obtain a strengthened fiber assembly:

$$947+0.30\times\log_{(10)}t+0.046\times T-3.53\times C+645\times\log_{(10)}C=value$$

where t is the time in minutes during which said fiber assembly is contacted with said aqueous N-methylmorpholine-N-oxide solution, T is the temperature of said aqueous N-methylmorpholine-N-oxide solution in °C. and C is concentration of N-methylmorpholine-N-oxide in percent by mass, based on said aqueous N-methylmorpholine-N-oxide solution, and wherein value is a number in the range of 0.30 to 1.70 when T is less than 130° C. and C is in the range of 70 and 84% by mass, and washing said strengthened fiber assembly.

2. A process in accordance with claim 1, wherein the value is a number in the range of 0.5 to 1.5.

3. A process in accordance with claim 1, wherein the value is a number in the range of 0.8 to 1.2.

4. A process in accordance with claim 1, wherein T is less than 100° C.

5. A process in accordance with claim 1, further comprising pressing said strengthened fiber assembly prior to washing.

6. A process in accordance with claim 1, wherein said fiber assembly contains fibers at least partially produced by an amine oxide process.

7. A process in accordance with claim 1, wherein said fiber assembly contains fibers at least partially produced by a viscose process.

* * * * *

UNITED STATES PATENT AND TRADEMARK OFFICE

CERTIFICATE OF CORRECTION

PATENT NO. : 6,042,890
DATED : March 28, 2000
INVENTOR(S) : Ruf et al.

It is certified that error appears in the above-identified patent and that said Letters Patent is hereby corrected as shown below:

ON THE COVER:

[57] ABSTRACT, line 11: "indicatcs thc tcmpcraturc of thc aqucous" should read
-- indicates the temperature of the aqueous --

IN THE CLAIMS:

Column 5, line 7: "947" should read
-- −947 --; and "$\log_{(10)}$)" should read
-- $\log_{(10)}$ --

Column 6, line 14: "proccss" should read
-- process --; "accordancc" should read
-- accordance --; and "whcrcin" should read
-- wherein --

UNITED STATES PATENT AND TRADEMARK OFFICE

CERTIFICATE OF CORRECTION

PATENT NO. : 6,042,890
DATED : March 28, 2000
INVENTOR(S) : Ruf et al.

It is certified that error appears in the above-identified patent and that said Letters Patent is hereby corrected as shown below:

Column 2, line 17: "mninuted" should read
-- minuted --

Column 3, line 45: "slightly" should read
-- Slightly --

Column 3, line 65: "parmeters" should read
-- parameters --

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*